United States Patent [19]

Ruddick

[11] Patent Number: 4,836,254

[45] Date of Patent: Jun. 6, 1989

[54] MULTIHEAD INCISOR FOR LUMBER, TIMBER AND THE LIKE

[75] Inventor: John N. R. Ruddick, West Vancouver, Canada

[73] Assignee: Forintek Canada Corporation, Vancouver, Canada

[21] Appl. No.: 264,845

[22] Filed: Oct. 31, 1988

[51] Int. Cl.[4] ..... B27E 9/04; B27M 1/02

[52] U.S. Cl. ..... 144/362; 29/121.6; 100/121; 100/176; 144/2 J

[58] Field of Search ..... 29/121.6; 100/121, 176; 144/2 J, 362, 2 R

[56] References Cited

U.S. PATENT DOCUMENTS

| | | | |
|---|---|---|---|
| 1,675,042 | 6/1928 | Nelson | 144/362 |
| 4,137,956 | 2/1974 | Toberg | 144/2 J |
| 4,318,433 | 3/1982 | Amundsen | 144/2 J |
| 4,691,629 | 9/1987 | Koba | 100/121 |
| 4,706,722 | 11/1987 | Silcox | 144/2 J |

*Primary Examiner*—W. Donald Bray
*Attorney, Agent, or Firm*—Fetherstonhaugh & Co.

[57] ABSTRACT

A multihead incisor for incising at least two sides of lumber or timber and in one pass produces a higher incision density than can be achieved without two or more passes on existing single roll incisors. The incisor comprises at least two sets of incisor rolls, each set having two or more rolls spaced apart in one plane representing a side of a piece of lumber or timber moving in the one plane, a first incisor roll in each set having incising teeth positioned to make a pattern of incisions in the one plane, a second incisor roll in each set, downstream of the first incisor roll, positioned to make a second pattern of incisions over the first pattern of incisions in the one plane, and a system to synchronize rotation of the first and second incisor rolls in each set to ensure combination of the first and second patterns of incisions is to a predetermined final pattern of closely spaced apart incisions on at least two sides of a piece of lumber or timber.

13 Claims, 4 Drawing Sheets

MULTIHEAD INCISOR FOR LUMBER, TIMBER AND THE LIKE

FIELD OF INVENTION

The present invention relates to lumber and timber incising, and more specifically, to a multihead incisor for producing close space incising patterns on two or more surfaces of a piece of lumber or timber.

BACKGROUND OF THE INVENTION

Incising is carried out on lumber or timber to form punctures or incisions in the surface to permit penetration of preservatives and the like into the lumber. In today's markets, better penetration of preservatives is required and tests carried out show that in order to obtain a proper penetration of preservatives in certain wood species, close spacing of incisions or penetrations is required on preferably all four surfaces of a piece of wood or timber.

Devices for incising lumber generally include an incision roll for at least one surface. The roll has a series of teeth and a pressure is applied between the roll and the surface of the wood so the teeth penetrate. If the incisions are too close together, it has been found that wood strands, slivers or splinters are stripped from the face of the lumber which not only reduces the grade of the lumber, but also clogs up the teeth of the incising rolls. Comb type or spacer ring cleaning systems are often provided in spaces left between discs having incising teeth on their periphery. One method of preventing slivers from forming has been developed by Silcox and is disclosed in U.S. Pat. No. 4,706,722. This patent describes a lumber incisor with a plurality of incisor discs with teeth on the periphery, mounted on a shaft with a plurality of annular cleaning rings between the incisor discs which freely move and during the incising operation are pushed upwards or downwards depending on the position of the wood relative to the incising roll, thus cleaning wood strands, splinters or slivers caught in the incising teeth. Annular cleaning rings or combs with cleaning teeth between incisor discs require a space between the incisor discs that does not permit a close pattern of incisions to be made with a single roll.

The preservative lateral penetration in one direction from a single incision is in the order of 1 to 2 mm for spruce and lodgepole pine. Thus the spacing between rows of incisions must, therefore, be reduced to less than 3 mm.

The incision density required to treat, for example, spruce heart wood to Canadian standards is over 10,000 incisions per square meter. These incision densities cannot be achieved with a single incisor roll without strands, slivers or splinters being formed resulting in damage to the surface of the wood and also clogging of the incisor roll with the inevitable result of considerable downtime to clean the machine and prevent incisor tooth breakage.

Dual incisors have been provided for incising veneer, however, veneer incision is for a different purpose from that of timber or lumber incision. Veneer incision is provided to expand green veneer or to prevent contraction or warping when the veneer is subsequently formed into plywood and the like. One example of a multiple roll incision arrangement for veneer is disclosed in U.S. Pat. No. 4,655,869 to Tellman et al. While this patent does disclose two rollers in line, it does not suggest that the rolls be synchronized to form a pattern of incisions, and in fact discloses at column 3, line 41, that the sheet may be run through the nip up to four times on each side to achieve a desired expansion. Furthermore, the patent relates to green veneer to cause expansion, thus preventing contraction of the veneer during the drying step.

SUMMARY OF THE INVENTION

An aim of the present invention is to provide an apparatus for incising at least two sides and preferably four sides of a piece of wood with a closely spaced pattern of incisions and at the same time avoiding stripping of wood strands, slivers or splinters from the surface of the wood and clogging of incising teeth in incisor rolls.

It is a further aim of the present invention to provide a multihead incisor for lumber, timber and the like which incises two or more surfaces of the piece of lumber or timber in a single pass thus avoiding the time required to incise each side separately, and to create the required incision pattern for pressure treatment of sawn wood for species such as spruce, lodgepole pine and jackpine. These species require a high incision density in order to obtain the required preservative penetration.

The present invention provides an apparatus for incising at least two sides of a piece of lumber, timber, or the like in one pass, comprising: at least two sets of incisor rolls, each set having two or more rolls spaced apart in one plane representing a side of a piece of lumber moving in the one plane, a first incisor roll in each set having incising teeth positioned to make a first pattern of incisions in the one plane, a second incisor roll in each set, downstream of the first incisor roll, positioned to make a second pattern of incisions over the first pattern of incisions in the one plane, and means to synchronize rotation of the first and second incisor rolls in each set to ensure a combination of the first and second patterns of incisions is to a predetermined final pattern of closely spaced apart incisions on at least two sides of the piece of lumber or timber.

In another embodiment of the invention, all four sides of a piece of lumber or timber are incised in one pass and four sets of incisor rolls are provided with a first two sets of incisor rolls being in one plane opposite each other positioned to form roll nips for incising opposite sides of the piece of the lumber or timber, and the second two sets of incisor rolls being in the perpendicular plane to the first two sets of incisor rolls, positioned to form roll nips for incising other opposite sides of the piece of lumber or timber. Means are provided in the apparatus to vary the distance between opposing incisor rolls to account for different thicknesses of lumber or timber in the two planes.

In another embodiment, the incisor rolls comprise a plurality of circular discs mounted on a shaft, each having a plurality of teeth about the periphery of the disc, and the discs are spaced evenly apart along the shaft. Between the circular discs, spaces are provided and teeth cleaning devices such as combs or floating annular rings, are positioned to remove wood strands, splinters, slivers and the like from the incising teeth during the incision step.

In another embodiment of the invention, there is provided a method of incising at least two sides of a piece of lumber, timber or the like in one pass, comprising the steps of passing a piece of lumber or timber in a predetermined path, making a first pattern of incisions on at least two sides, making a second pattern of incisions on the two sides downstream of the first pattern of incisions and on top of the first pattern of incisions, synchronizing the making of the second pattern of incisions to ensure the combination of the first and second patterns of incisions is to a predetermined final pattern of closely spaced apart incisions on at least two sides of the piece of lumber or timber.

LIST OF DRAWINGS

In drawings which illustrate embodiments of the present invention:

DESCRIPTION OF THE PREFERRED EMBODIMENT

Figure 1:
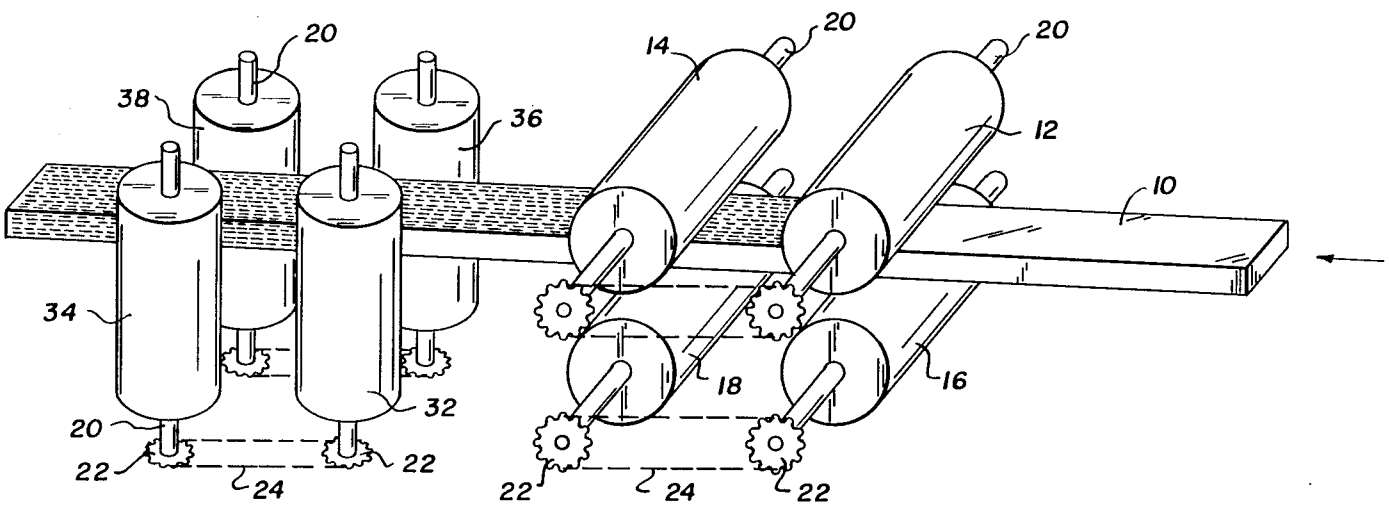
FIG. 1 is a diagrammatic isometric view showing multiple heads of an incising apparatus according to one embodiment of the present invention.

The multiple head incisor of the present invention is illustrated in FIG. 1 for incising all four sides of a piece of lumber 10. The actual pattern arrangement required on the surface of the lumber 10 is determined by the required preservative penetration and with many wood species this calls for incisions to be spaced apart to produce over about 10,000 incisions per square meter.

A first incisor roll 12 is arranged to incise a top surface of the lumber 10 which passes in a predetermined path through the apparatus. A second incisor roll 14 is positioned downstream from the first incisor roll 12, and the pattern of incisions formed will be disclosed hereafter. The second incisor roll 14 produces a pattern of incisions on the first pattern produced by the first incisor roll 12. On the underside of the lumber 10, there is provided a first bottom incisor roll 16 which forms a nip with the first top incisor roll 12 and a second bottom incisor roll 18 which also forms a nip with the second top incisor roll 14. Thus when the lumber 10 passes between these two sets of rolls, i.e. the top set and the bottom set, a closely spaced pattern of incisions is provided on both top surface and bottom surface of the lumber. Each incisor roll is mounted on a shaft 20 which in turn has at one end sprockets 22 connected to a chain 24 thus providing synchronization so that the incisor rolls of one set, namely the top set 12 and 14 or the bottom set 16 and 18, ensure that the patterns coincide to form a final pattern of closely spaced incisions.

Downstream of the incisor rolls 12, 14, 16 and 18, which incise the top and bottom surfaces of the lumber 10, are two further sets of incisor rolls perpendicular to the first sets, one set of rolls 32 and 34 incise one side of the lumber and a second set of rolls 36 and 38 incise the opposite side of the lumber 10, thus ensuring that when the lumber finally issues from the incisor, it is incised on all four sides. Sprockets 22 are attached to shafts 20 supporting the rolls 32, 34, 36 and 38. Sprockets 22 are attached at one end to the shafts 20 and chains 24 ensure that the incisor rolls on one side are synchronized so that the pattern of incisions is always in accordance with a predetermined closely spaced pattern to provide the correct incision density for the surface of the wood.

In one embodiment of synchronizing the pairs of incisor rolls, the distance between axes of the roll shafts 20 is a multiple of the distance between the points or centres of two adjacent incising teeth on an incisor disc, measured around the circumference of the disc when the teeth are embedded into the wood surface.

When one lateral row of teeth across the first roll are fully inserted into the wood surface, a row of teeth on the second roll are similarly inserted. The rolls may be synchronized to achieve the desired combination pattern. The sprockets 22 have the same number of teeth, and each sprocket teeth is aligned with an incising tooth on at least one of the incisor discs. The chain 24 ensures both sprockets rotate together to keep their synchronization.

Provision is made to move the sets of rolls apart to take into account different sizes of lumber or timber, both from the point of view of width and thickness, thus all types of sawn lumber can be incised on all four sides at the same time in a single pass. The depth of incision is determined upon the requirement for preservative penetration. Typically, the preservative penetration from a single incision for spruce or jackpine is 25 to 40 mm long and 3 to 4 mm across.

Figure 2:
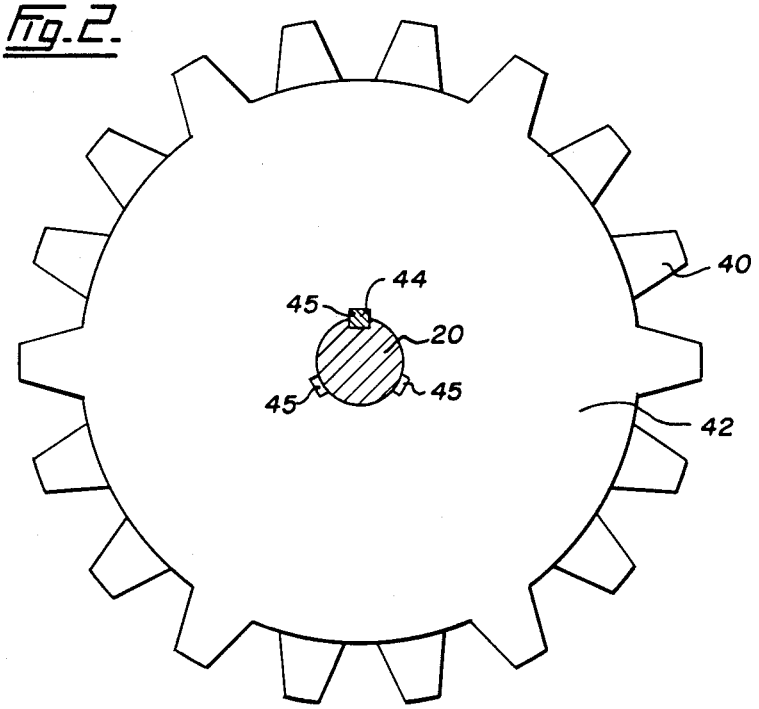
FIG. 2 is a partial side view showing a circular disc with incising teeth thereon.

FIG. 2 illustrates an example of an incisor. Incising teeth 40 are shown around the periphery of a disc 42 and in this particular embodiment are wedge shaped. The spacing between the teeth 40 is staggered from one disc to another to provide a required pattern of incisions which will be disclosed hereafter. Each disc 42 is mounted on the shaft 20 with a key 44 or other locking arrangement to ensure that the discs 42 remain permanently attached to the shaft 20 and do not rotate individually from the shaft 20. Three key ways 45 are shown equispaced around shaft 20 and adjacent discs 42 are arranged to be keyed to the different keyways 45 to provide the staggered arrangement. This allows all discs 42 to be made identical.

Figure 3:
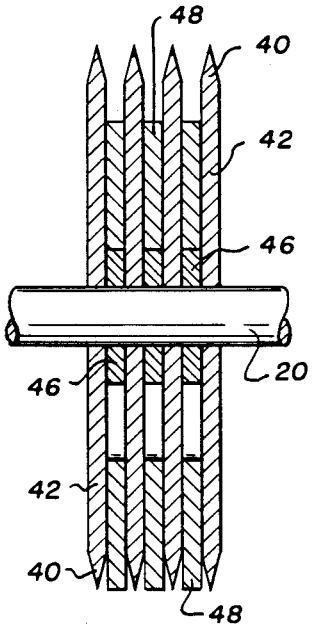
FIG. 3 is a partial sectional view through an incisor roll showing the arrangement of circular discs and a system of floating annular rings to clean the incising teeth.

FIG. 3 illustrates one embodiment of an arrangement of four discs 42 with incising teeth 40 thereon. Between the discs 42 are spacers 46 which position the discs 42 apart and between the spacers 46 are floating annular rings 48 having a thickness less than the spacers 46 and, therefore, float between the discs 42. The floating annular rings 48 have a diameter at least as large as the outside diameter of the discs with the incising teeth 40 thereon, therefore, when the incising teeth 40 are incising a surface of a piece of lumber or timber, the floating annular rings are pushed outside the periphery of the incising teeth 40 opposite the place where incising occurs to clean the teeth of all slivers or splinters of wood that might be retained therein.

Figure 4:
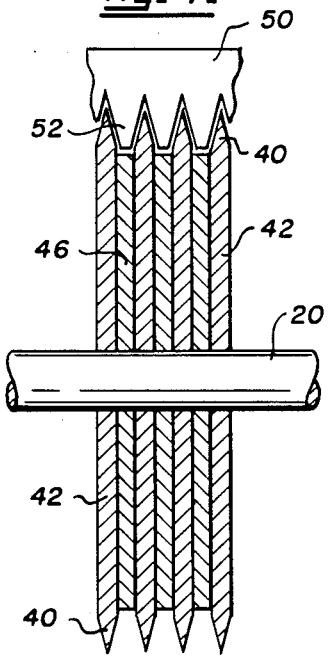
FIG. 4 is a partial sectional view through an incisor roll showing the arrangement of circular discs and a comb system with cleaning teeth to clean the incising teeth.

FIG. 4 shows another embodiment of four discs 42 with incising teeth 40 thereon. Spacers 40 between the discs 42 are fixed and do not rotate, the spacer 46 have a diameter that is almost that of the base of the incising teeth 40 on the discs 42. A comb 50 with cleaning teeth 52 is fixed so that the teeth 52 project into the spaces between the incising teeth 40 to remove any wood strands, slivers or the like that build up. The comb 50 is preferably placed at angle and the cleaning teeth 52 rest on the outside periphery of the spacer rings to act as type of scoop to remove wood particles.

Figure 5:
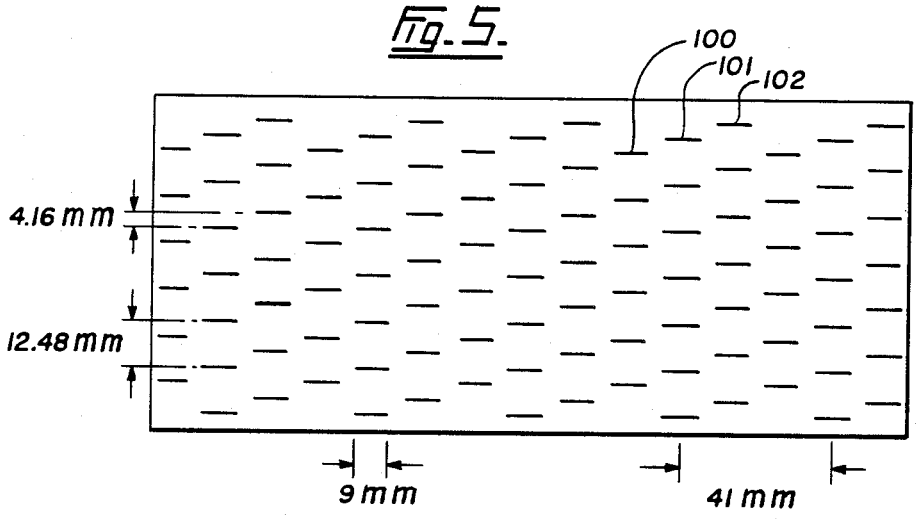
FIG. 5 is a plan view illustrating a first pattern of incisions on a face of a piece of wood.

FIG. 5 illustrates a first pattern of incisions made in the surface of one side of a piece of lumber or timber after passing under a first incisor roll. As can be seen, the incising teeth are arranged to be spaced apart in three separate discs identified as rows 100, 101 and 102, each row has the incising teeth staggered to provide incisions between incising teeth on each disc of 41 mm. The actual incision represents 9 mm in width, the spacing between each disc is 4.16 mm and the spacing between the three rows of incisions on the three staggered discs is 12.48 mm.

Figure 6:
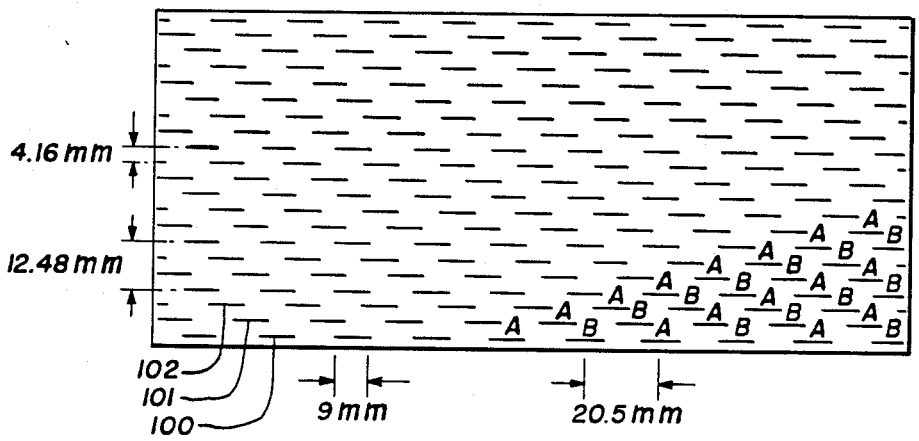
FIGS. 6, 7 and 8 are plan views illustrating different combination patterns on a face of a piece of wood after a first and second incising step.
Figure 7:
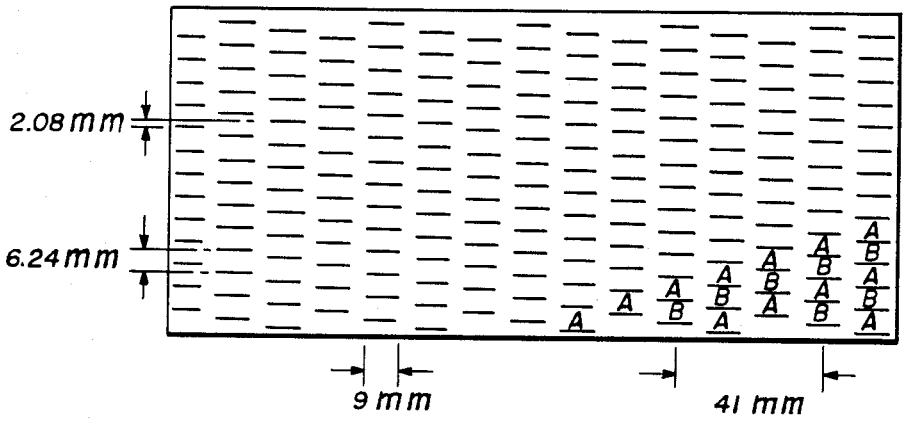
Figure 8:
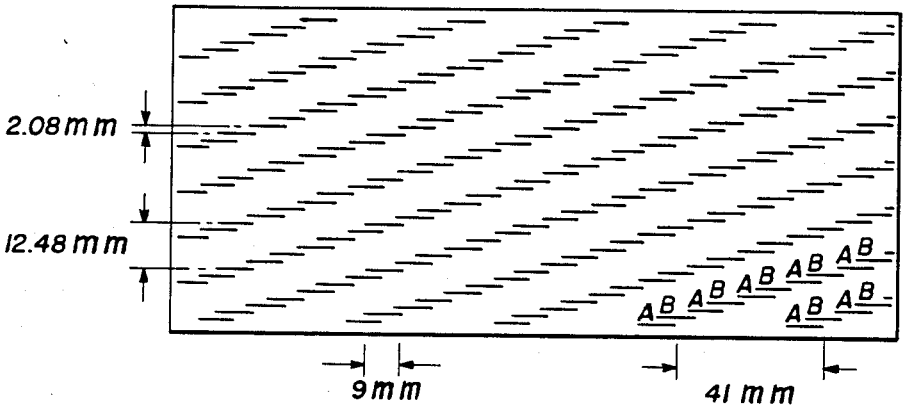

Following the first pattern of incisions as shown in FIG. 5, the surface of the wood then passes under the second incisor roll and a second pattern is superimposed upon the first pattern. Three types of combined or final patterns are illustrated in FIGS. 6, 7 and 8. FIG. 6 shows a pattern described as a "Double in line" incising pattern. The rows of incisions which represent the spacing between the discs is the same for the second pattern as for the first pattern, however, the second pattern provides incisions spaced between those of the first pattern. Incisions A shown in FIG. 6 represent the incisions from the first pattern shown in FIG. 5 and incisions B shown in FIG. 6 represent the incisions from the second pattern produced by the second incisor roll. The spacing between incisions in each row is now reduced from 41 mm to 20.5 mm, however, the spacing between the discs remains the same and does not change. Thus the second pattern shown in FIG. 6 produces double the number of incisions per square meter than that of the pattern shown in FIG. 5.

FIG. 7 illustrates a pattern described as a "Double Parallel" incising pattern, wherein the incisions B are positioned between the incisions A in a transverse row across the pattern. FIG. 8 illustrates a further pattern described as a "Double Staggered" incising pattern, with the incisions B positioned between incisions A in diagonal rows. This last pattern leaves spaces or skips between staggered rows of incisions which in some wood species may not be satisfactory.

In order to achieve this final predetermined pattern of incisions, the rotation of the rolls are synchronized. Whereas a combination sprocket and chain arrangement are illustrated, the synchronization could be by mechanical, electronic, hydraulic or electrical means, one or other or both of the shafts may be driven by a power source, and when opposing sets of rolls are used as illustrated in FIG. 1, then only one of the sets of rolls need be driven.

Whereas the embodiments shown in FIG. 1 have opposing incisor rolls, it will be apparent to those skilled in the art that one roll of the opposing rolls may be an incisor roll and the other roll may be a plane roll, either an idler or a driven roll to provide pressure and push the lumber or timber against the incising teeth. Guide rollers at the sides and before the incisor rolls may also be provided to ensure that the timber or lumber follows a predetermined path.

In order to determine the effect of this preservative penetration, samples of treated lodgepole pine with a single pattern of incision as shown in FIG. 5 and a double pattern of incisions as shown in FIG. 6 were assessed by taking small cores from between the incisions as would be done for a normal charge inspection. Overall improvements for the incisions of the present invention were in the order of 33 to 46%. The incision depth in the material was 6 to 7 mm and, therefore, the material would meet the proposed CITW out of ground contact specification of 5 mm penetration for the decking market The percentage of the boards with 4.5 mm or greater penetration was calculated for each incision density. The boards with the two patterns on incisions thereon exceeded the pass rate of 80% .

Analysis of preservative retention was also carried out using standard methodology on pooled samples from all boards. Improvements of around 40% were achieved. The specified retention in the proposed CITW decking specifications was almost met with spruce and exceeded with lodgepole pine. A third measurement determined the percentage area treated at a 5 mm depth. This measurement shows up the extent of areas of shallow penetration between incisions and is a measure of the integrity of the treated shell. The sample was routed out to half the specified depth and sprayed with chrome azurol S. A grid was placed on the exposed surface and the number of treated and untreated squares was estimated. The present development increased the shell integrity from around 50 to 85%.

Surface appearance of the material incised dry was excellent compared to that given by blunt teeth, but not as good as that achieved on green lumber.

Various changes may be made to the embodiments described herein without departing from the scope of the present invention which is limited only by the following claims.

The embodiments of the invention in which an exclusive property or privilege is claimed are defined as follows:

1. An apparatus for incising at least two sides of a piece of lumber, timber, or the like in one pass comprising:

at least two sets of incisor rolls, each set having two or more rolls spaced apart in one plane representing a side of a piece of lumber or timber moving in the one plane;

a first incisor roll in each set having incising teeth positioned to make a pattern of incisions in the one plane;

a second incisor roll in each set, downstream of the first incisor roll, positioned to make a second pattern of incisions over the first pattern of incisions in the one plane, and means to synchronize rotation of the first and second incisor rolls in each set to ensure combination of the first and second patterns of incisions is to a predetermined final pattern of closely spaced apart incisions on at least two sides of a piece of lumber or timber.

2. The apparatus according to claim 1 wherein all four sides of a piece of lumber or timber are incised in one pass, comprising four sets of incisor rolls with a first two sets of incisor rolls being in one plane opposite each other positioned to form roll nips for incising opposite sides of a piece of lumber or timber, and the second two sets of incisor rolls being in the perpendicular plane to the first two sets of incisor rolls, positioned to form roll nips for incising other opposite sides of a piece of lumber or timber.

3. The apparatus according to claim 2 including adjustment means to vary the distance between opposing incisor rolls to account for different thicknesses of lumber or timber in the two planes.

4. The apparatus according to claim 1 wherein the means to synchronize rotation of the first and second incisor rolls in each set comprises rotation means for one incisor roll and sprocket and chain connection means between the first and second incisor rolls.

5. The apparatus according to claim 1 wherein the means to synchronize rotation of the first and second incisor rolls comprises driving the incisor rolls in timed relation by means selected from the group consisting of at least one mechanical, hydraulic, electrical and electronic means.

6. The apparatus according to claim 1 wherein the incisor rolls each comprise a plurality of circular discs mounted on a shaft, each having a plurality of teeth about the periphery of each of the circular discs, the discs spaced evenly apart along the shaft.

7. The apparatus according to claim 6 wherein spaces are provided between the circular discs and means to remove wood strands, splinters, slivers and the like from the incising teeth are provided in the spaces.

8. The apparatus according to claim 7 wherein the means to remove wood strands, splinters and the like comprise floating annular rings, thinner than the spaces, loosely mounted between the discs.

9. The apparatus according to claim 7 wherein the means to remove wood strands, splinters and the like comprise at least one comb with cleaning teeth extending into the spaces.

10. The apparatus according to claim 1 wherein each set of incisor rolls has a set of smooth rolls on the other side of the piece of lumber or timber to press the side of lumber or timber against the incisor rolls, and including adjustment means to vary the distances between the incisor rolls and the smooth rolls to account for different thicknesses of lumber or timber.

11. A method of incising at least two sides of a piece of lumber, timber or the like in one pass, comprising the steps of:

passing a piece of lumber or timber in a predetermined path;

making a first pattern of incisions on at least two sides;

making a second pattern of incisions on the two sides downstream of the first pattern of incisions and on top of the first pattern of incisions, synchronizing the making of the second pattern of incisions to ensure the combination of the first and second patterns of incisions is to a predetermined final pattern closely spaced apart incisions on at least two sides of the piece of lumber or timber.

12. The method according to claim 11 wherein four sides of the piece of lumber or timber are incised in one pass.

13. The method according to claim 11 wherein the first and second patterns are made with an incisor roll having a plurality of circular discs with increasing teeth thereon, the discs having spaces therebetween and within the spaces are provided means to remove wood strands, splinters, slivers and the like from the incising teeth.

* * * * *